US010578402B1

(12) United States Patent
McCoy, II

(10) Patent No.: US 10,578,402 B1
(45) Date of Patent: Mar. 3, 2020

(54) LEVEL INDICATOR FOR AIMING SYSTEMS

(71) Applicant: Charles A. McCoy, II, Bellingham, WA (US)

(72) Inventor: Charles A. McCoy, II, Bellingham, WA (US)

( * ) Notice: Subject to any disclaimer, the term of this patent is extended or adjusted under 35 U.S.C. 154(b) by 0 days.

(21) Appl. No.: 15/808,810

(22) Filed: Nov. 9, 2017

Related U.S. Application Data

(60) Provisional application No. 62/420,389, filed on Nov. 10, 2016.

(51) Int. Cl.
*F41G 1/44* (2006.01)
*F41G 1/54* (2006.01)

(52) U.S. Cl.
CPC ..... *F41G 1/44* (2013.01); *F41G 1/54* (2013.01)

(58) Field of Classification Search
CPC ..... F41G 1/44; F41G 3/10
USPC ..... 42/120; 124/87
See application file for complete search history.

(56) References Cited

U.S. PATENT DOCUMENTS

| | | | |
|---|---|---|---|
| 191,389 | A | 5/1877 | Ward et al. |
| 2,529,801 | A | 11/1950 | Fisk |
| 2,782,511 | A | 9/1954 | Ivy |
| 2,748,494 | A | 6/1956 | Raney |
| 2,886,998 | A | 5/1959 | Scott |
| 3,041,938 | A | 7/1962 | Seabrook |
| 3,568,324 | A | 3/1971 | Jorczak |
| 3,624,947 | A | 12/1971 | Worrall |
| 4,208,801 | A | 6/1980 | Blair |
| 5,005,308 | A | 4/1991 | Parks |
| 5,223,650 | A | 6/1993 | Finn |
| 5,315,781 | A | 5/1994 | Beisner |
| 5,406,733 | A | 4/1995 | Tarlton et al. |
| 5,459,935 | A | 10/1995 | Paulson et al. |
| 5,630,279 | A | 5/1997 | Slates |
| 5,657,571 | A | 8/1997 | Peterson |
| 5,878,504 | A | 3/1999 | Harms |
| 6,237,462 | B1 | 5/2001 | Hawkes et al. |
| 6,499,382 | B1 | 12/2002 | Lougheed et al. |

(Continued)

FOREIGN PATENT DOCUMENTS

| | | | |
|---|---|---|---|
| DE | 334394 | 3/1921 | |
| EP | 0497301 A2 * | 8/1992 | ..... F41G 1/44 |

(Continued)

OTHER PUBLICATIONS

International Searching Authority, ISR & Written Opinion, PCT/US2017/050136, dated Jan. 11, 2018, 7 pages.

(Continued)

*Primary Examiner* — Stephen Johnson
(74) *Attorney, Agent, or Firm* — Michael R. Schacht; Schacht Law Office, Inc.

(57) ABSTRACT

A level indicator system for an aiming system comprising a base assembly, a level assembly. The base assembly comprises a base member defining a base axis, a plate, and a support member. The level assembly comprises a level indicator defining a level axis. The base member and the plate support the support member such that a location of the plate relative to the base member is adjustable. The support member supports the level assembly such that a location of the level axis relative to the base axis is altered when a location of the plate relative to the base member is adjusted.

18 Claims, 11 Drawing Sheets

(56) References Cited

U.S. PATENT DOCUMENTS

| | | | | |
|---|---|---|---|---|
| 6,701,632 | B2 * | 3/2004 | Henry | F41G 1/467 124/87 |
| 6,978,569 | B2 | 12/2005 | Williamson, IV et al. | |
| 7,530,193 | B2 | 5/2009 | Williamson, IV et al. | |
| 7,543,405 | B1 | 6/2009 | Ivey | |
| 8,051,574 | B1 | 11/2011 | Kronengold et al. | |
| 8,689,454 | B2 * | 4/2014 | Pulkrabek | F41G 1/467 124/87 |
| 8,695,266 | B2 | 4/2014 | Moore et al. | |
| 8,819,985 | B1 | 9/2014 | McCoy et al. | |
| 9,103,630 | B1 * | 8/2015 | McCoy | F41G 1/44 |
| 9,500,443 | B2 | 11/2016 | McCoy, II et al. | |
| 2006/0101700 | A1 | 5/2006 | Williamson, IV et al. | |
| 2006/0162227 | A1 | 7/2006 | Samson | |
| 2007/0113460 | A1 | 5/2007 | Potterfield et al. | |
| 2007/0175080 | A1 | 8/2007 | Sammut et al. | |
| 2009/0026679 | A1 | 1/2009 | Harman | |
| 2009/0107299 | A1 | 4/2009 | Ploeger | |
| 2012/0085014 | A1 | 4/2012 | Riley et al. | |
| 2015/0068098 | A1 | 3/2015 | Stokes et al. | |
| 2018/0094767 | A1 | 4/2018 | Mccoy | |

FOREIGN PATENT DOCUMENTS

| | | | |
|---|---|---|---|
| FR | 1289286 | A | 3/1962 |
| WO | 2018045389 | A1 | 3/2018 |

OTHER PUBLICATIONS

Canadian Airgun Forum, Mounting Solutions Anti-Cant Device, Sep. 14, 2008, 11 pages.

Junk Yard Genius, Mounting Solutions Anti-Cant Device, May 24, 2007, 4 pages.

Western Shooter, Mounting Solutions Anti-Cant Device, Apr. 18, 2008, 3 pages.

* cited by examiner

LEVEL INDICATOR FOR AIMING SYSTEMS

RELATED APPLICATIONS

This application, U.S. patent application Ser. No. 15/808,810 filed Nov. 9, 2017 claims benefit of U.S. Provisional Application Ser. No. 62/420,389 filed Nov. 10, 2016, the contents of which are incorporated herein by reference.

TECHNICAL FIELD

The present invention relates to level indicator systems and methods and, in particular, to level indicators for facilitating the establishment of a horizontal reticle plane.

BACKGROUND

Aiming systems allow a device, such as a camera, firearm, or the like to be pointed in a desired direction or at a desired target. The aiming system may include an optical system such as a scope that facilitates the pointing of the device at the desired target. The present invention is of particular significance when applied to a scope secured to a firearm such as a rifle, and that implementation of the present invention will be described in detail below. However, the present invention may be applied to other types of devices.

It is desirable in many situations that an optical system used to aim a device be aligned in at least one dimension with a horizontal plane. A level indicator such as a bubble level may be associated with the optical system to facilitate desired alignment of the optical system with horizontal. Often, the level indicator is an after-market device that is not built into the optical system.

The need exists for level indicator systems for use with aiming devices that can be adjusted as necessary to align the level indicator with a characteristic of an optical portion of the aiming system.

SUMMARY

The present invention may be embodied as a level indicator system for an aiming system comprising a base assembly and a level assembly. The base assembly comprises a base member defining a base axis, a plate, and a support member. The level assembly comprises a level indicator defining a level axis. The base member and the plate support the support member such that a location of the plate relative to the base member is adjustable. The support member supports the level assembly such that a location of the level axis relative to the base axis is altered when a location of the plate relative to the base member is adjusted.

The present invention may also be embodied as a method of leveling an aiming system comprising the following steps. A base member defining a base axis is provided. A plate and a support member are provided. A level assembly is provided, the level assembly comprising a level indicator defining a level axis. The level assembly is supported on the support member. The base member and the plate are arranged to support the support member such that a location of the plate relative to the base member is adjustable. The location of the plate is adjusted relative to the base member to alter a location of the level axis relative to the base axis.

The present invention may also be embodied as a level indicator system for an aiming system comprising a base assembly and a level assembly. The base assembly comprises a base member, a plate, a support member, and at least one screw. The base member defines a base axis, a plate notch, and a first pivot opening. The plate defines at least one screw opening and a second pivot opening. The level assembly comprises a level housing defining a level pivot opening and a level indicator defining a level axis, where the level housing supports the level indicator. The plate is supported by the plate notch in the base member. The support member extends at least partly through the first pivot opening, at least partly through the second pivot opening, and at least partly through the level pivot opening such that the level assembly pivots relative to the base member and the support member supports the level assembly such that a location of the level axis relative to the base axis is altered when a location of the plate relative to the base member is adjusted. The at least one screw is supported by the base member to extend at least partly into the at least one screw opening. The at least one screw engages at least a portion of the plate to fix the location of the plate relative to the base member.

DETAILED DESCRIPTION

Referring initially to FIGS. 1-4, depicted therein is an example firearm system 20 constructed in accordance with, and embodying, the principles of the present invention. The example firearm system 20 comprises an example firearm 30, an example telescopic sight 32, and an example level indicator system 34 constructed in accordance with, and embodying, the principles of the present invention. The telescopic sight 32 is conventionally detachably attached to the firearm 30 to facilitate aiming of the firearm 30. The example level indicator system 34 is detachably attached to the firearm 30 such that the level indicator system 34 may be used to align the telescopic sight 32 during aiming of the firearm 30. The example firearm 30 and the example telescopic sight 32 are or may be conventional and will be described herein only to that extent necessary for a complete understanding of the present invention.

Figure 13:
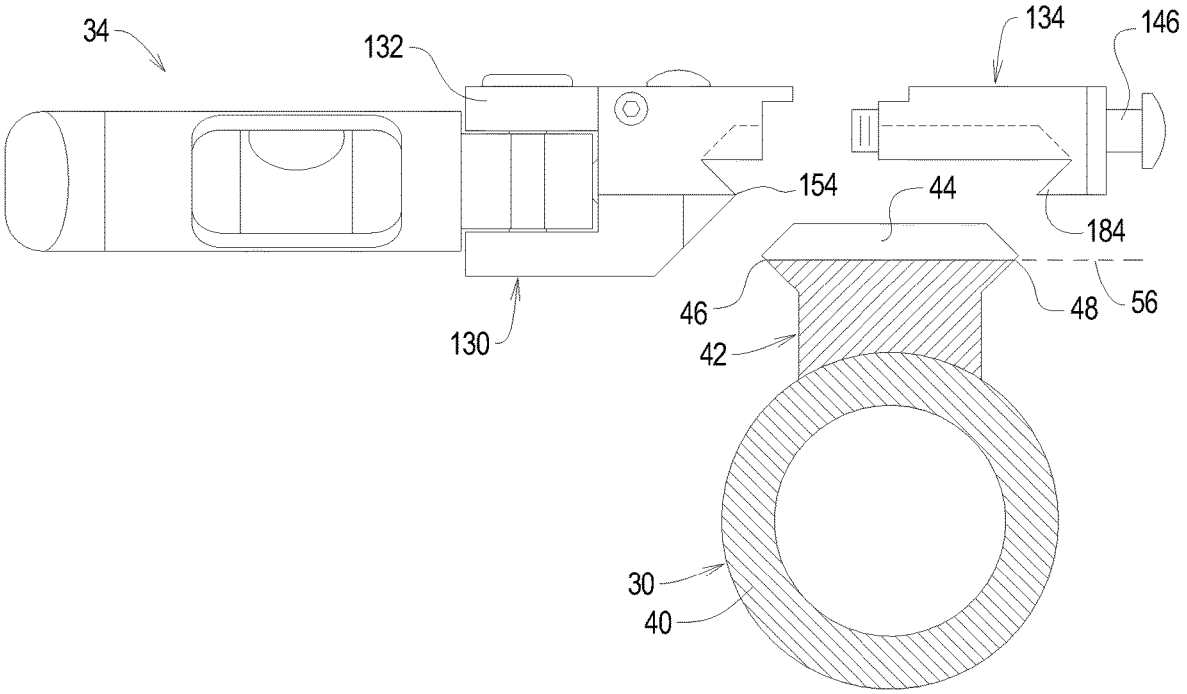
FIGS. 13 and 14 are front elevation partial section, partial exploded views taken along lines 14-14 in FIG. 2 illustrating the process of attaching the first example level indicator to a rail of an example firearm system.
Figure 14:
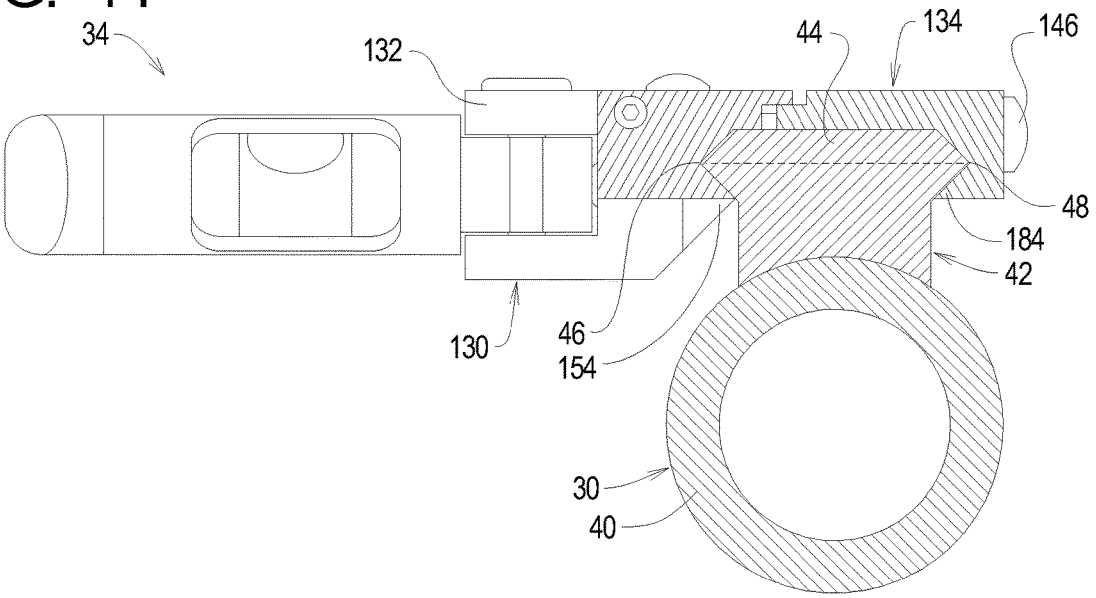

The example firearm 30 comprises a barrel 40 and a rail 42. The rail 42 defines rail projections 44 and first and second rail edges 46 and 48. The example rail 42 is integrally formed with or attached to the barrel 40. In addition, the example barrel 40 defines a barrel axis 50, the example telescopic sight 32 defines a sight axis 52, and the example level indicator system 34 defines a level axis 54. True horizontal is shown by reference character 58 in FIGS. 3 and 4. The example first and second rail edges 46 and 48 define a rail plane 56 as perhaps best shown in FIG. 13.

When the example telescopic sight 32 is properly detachably attached to the rail 42, the sight axis 52 is parallel to and spaced from both the barrel axis 50 and the rail plane 56. When the example first level indicator 34 is properly detachably attached to the rail 42 and properly adjusted as will be described in further detail below, the level axis 54 is substantially perpendicular to both the barrel axis 50 and the sight axis 52 and is substantially parallel to the rail plane 56.

Figure 1:
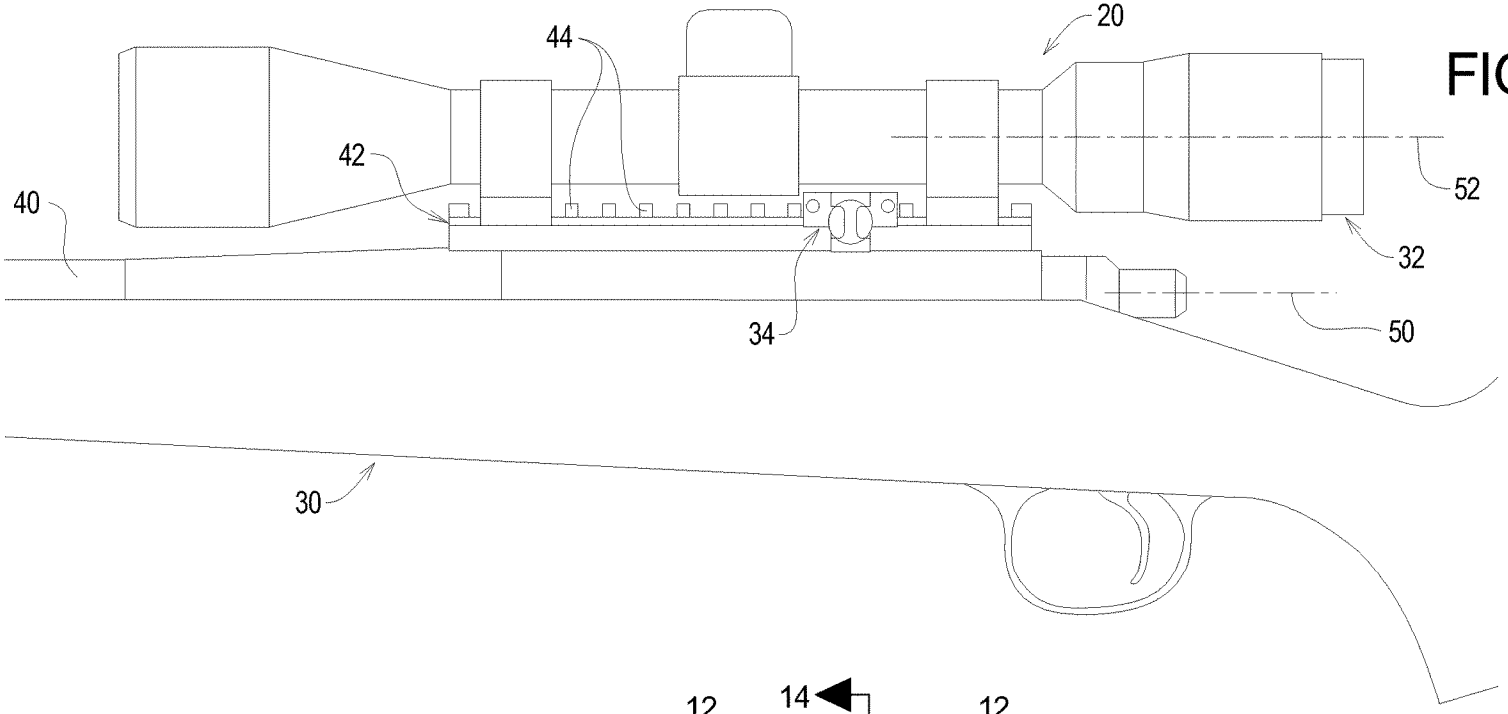
FIG. 1 is a side elevation view of an example firearm system incorporating a first example level indicator of the present invention.
Figure 2:
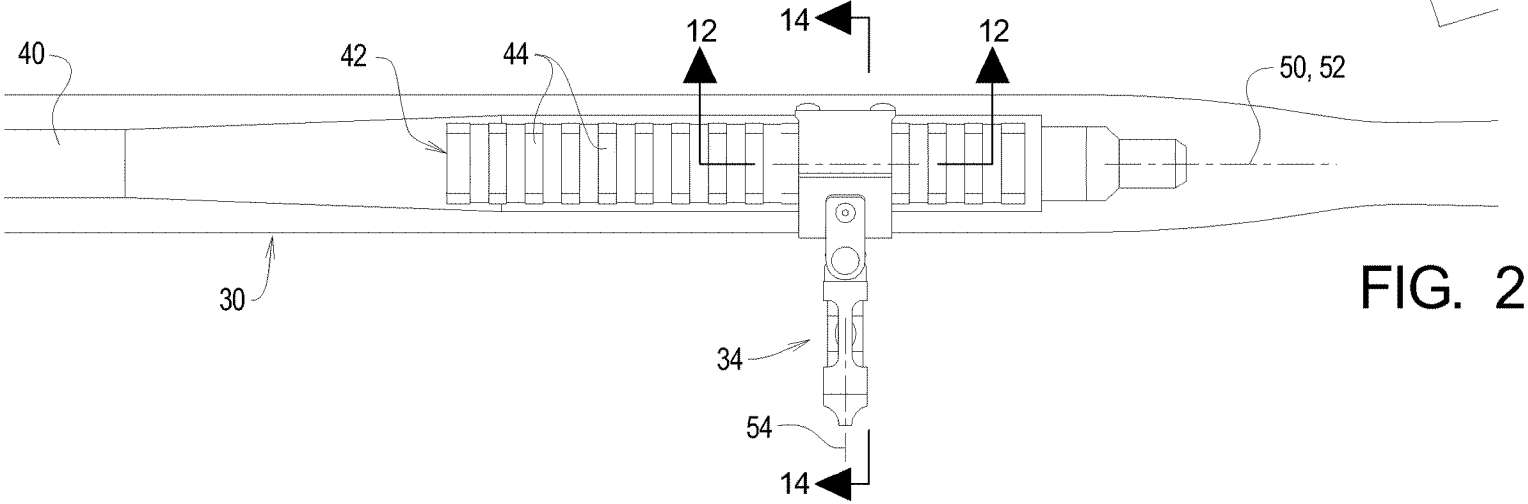
FIG. 2 is a top plan view of the example firearm system of FIG. 1.
Figure 3:
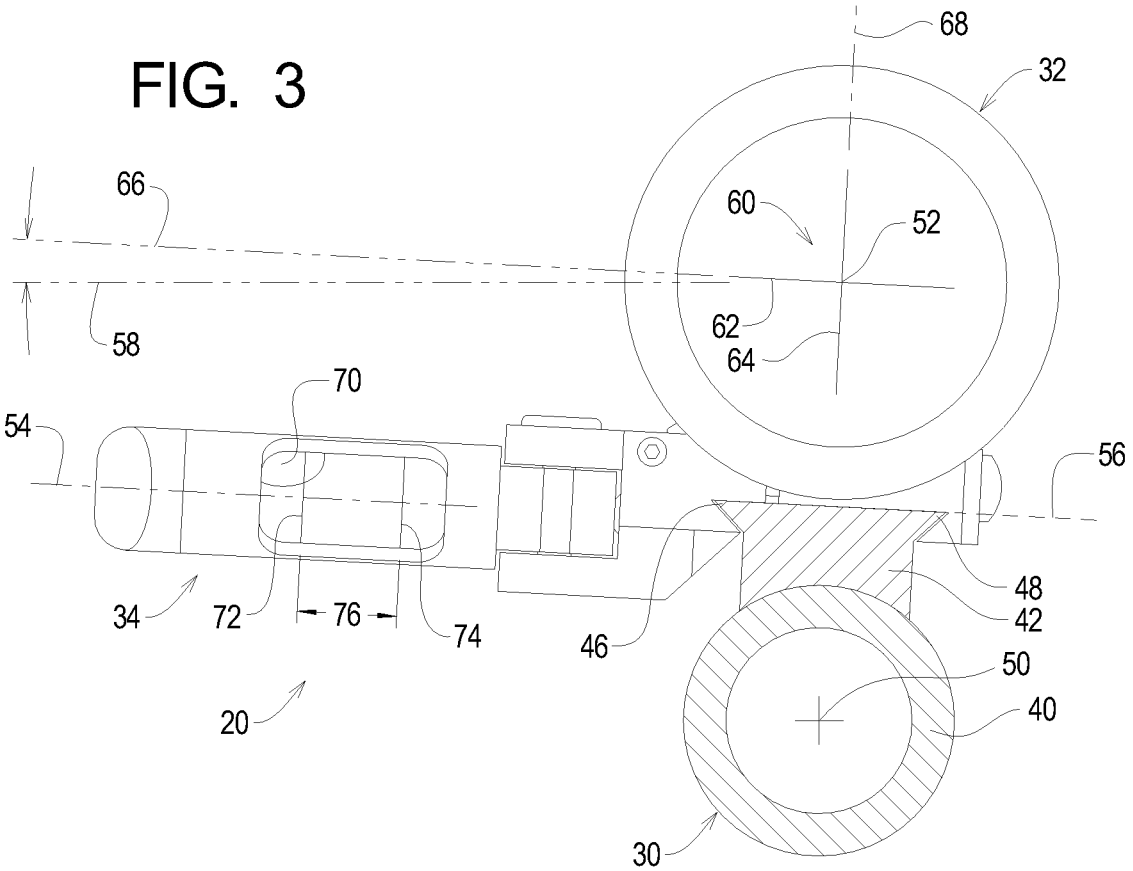
FIGS. 3 and 4 are front elevation, partial section views illustrating the use of the first example level indicator to establish a horizontal reticle plane of a telescopic sight of an example firearm system.
Figure 4:
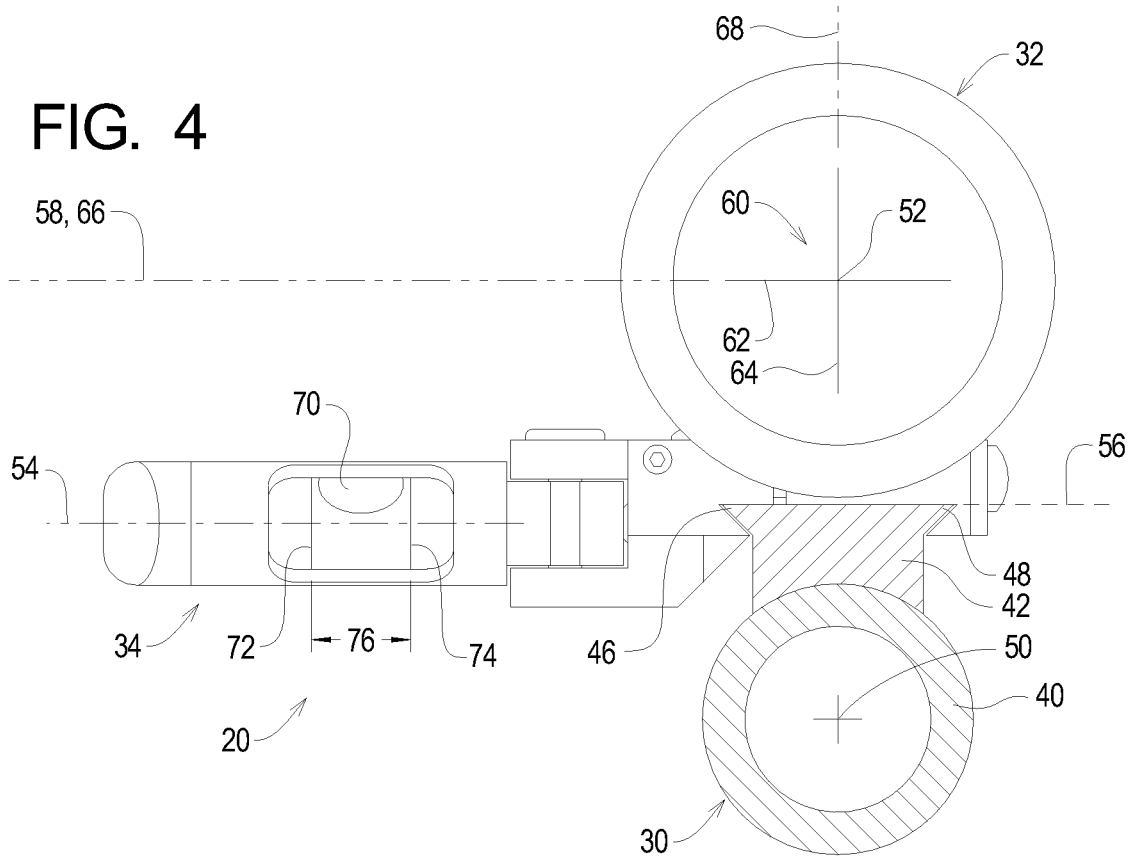

Turning now to FIGS. 3 and 4, it can be seen that the telescopic sight defines a reticle 60 comprising a first reticle line 62 and a second reticle line 64. The first reticle line 62 defines a horizontal reticle plane 66, and the vertical reticle line 64 defines a vertical reticle plane 68. The horizontal reticle line 62 and the vertical reticle line 64 are at right angles to each other and both intersect the sight axis 52 at the same point. The horizontal reticle plane 66 and the vertical reticle plane 68 also intersect at the sight axis 52. FIGS. 3 and 4 further illustrate that the first example level indicator system 34 defines a bubble 70 and first and second bubble lines 72 and 74. A level region 76 is defined between the first and second bubble lines 72 and 74.

During use of the firearm system 20, the example firearm 30 and telescopic sight 32 mounted thereon typically have at least some movement in free space to allow the firearm 30 to be aimed. This movement in free space means that the horizontal reticle line 62 and the horizontal reticle plane 66 associated therewith are not necessarily aligned with true horizontal 58. FIG. 3 illustrates the situation when the horizontal reticle line 62 and the horizontal reticle plane 66 associated therewith are not aligned with true horizontal 58. FIG. 3 also illustrates that the bubble 70 of the first example level indicator system 34 is at least partly outside of the level region 76 and intersects the first bubble line 72.

To properly align the horizontal reticle line 62 and the horizontal reticle plane 66 with true horizontal 58, the example firearm system 20 is rotated to the position shown in FIG. 4 in which the bubble 70 of the first example level indicator system 34 is entirely within the level region 76 and evenly spaced between the first and second bubble lines 72 and 74. The telescopic sight 32 is now properly arranged relative to true horizontal and true vertical and may be used in a conventional manner to aim the firearm 30.

Figure 5:
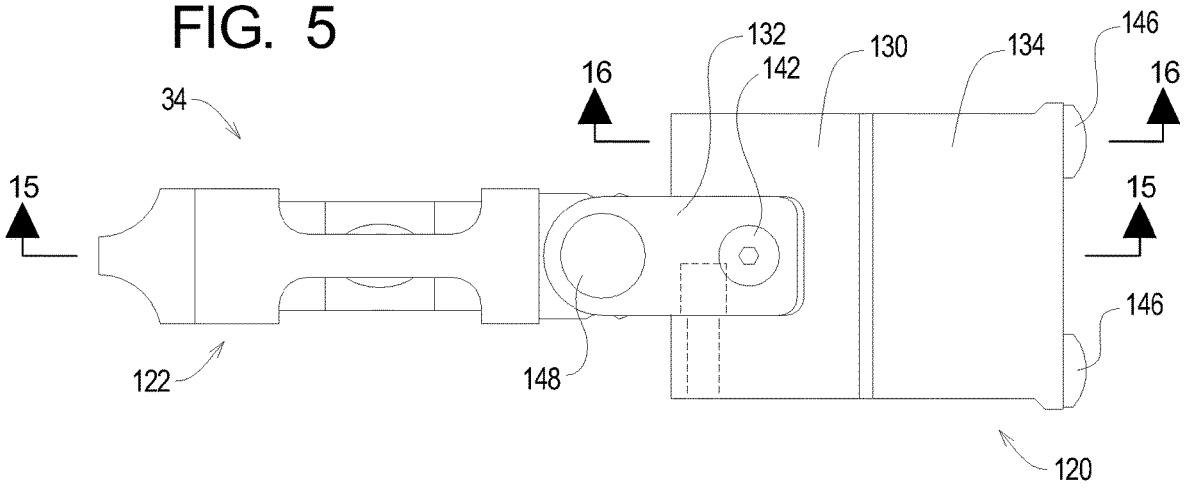
FIG. 5 is a top plan view of the first example level indicator in an extended position.
Figure 6:
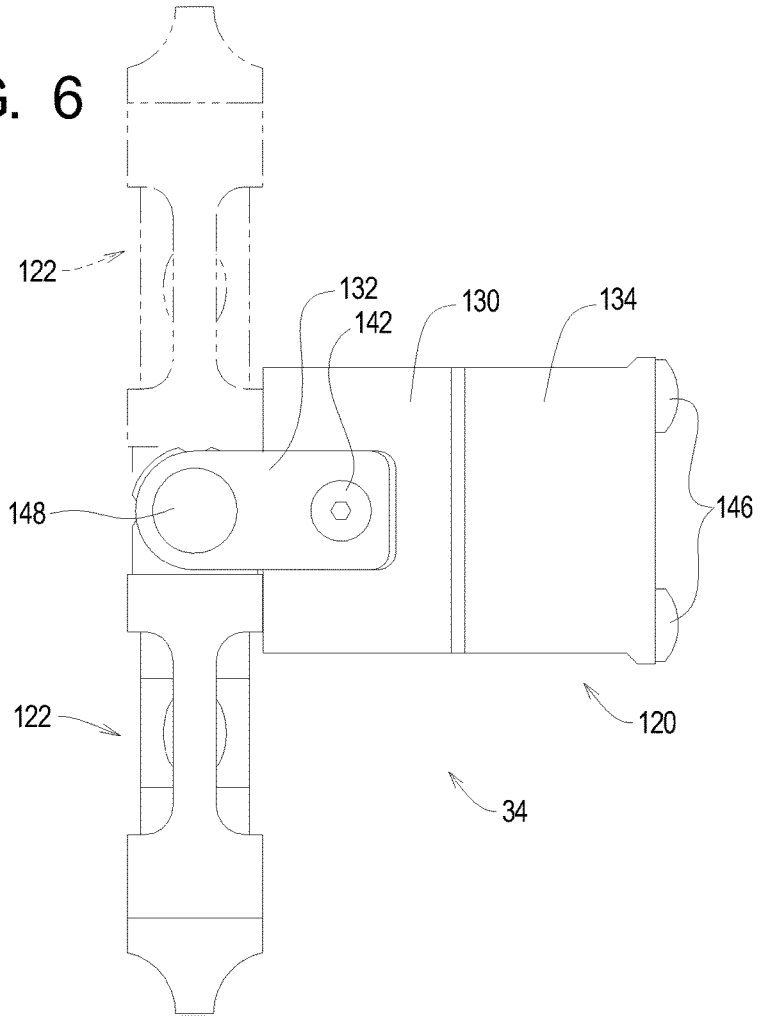
FIG. 6 is a top plan view of the first example level indicator in first (solid lines) and second (broken lines) retracted positions.

Turning now to FIGS. 5 and 6 of the drawing, that figure illustrates that the first example level indicator system 34 may be reconfigured between an extended configuration (FIG. 5) and first (solid lines) and second (broken lines) retracted positions (FIG. 6). The level indicator system 34 is typically used in the extended configuration and arranged in one of the retracted configurations when not in use.

Figure 7:
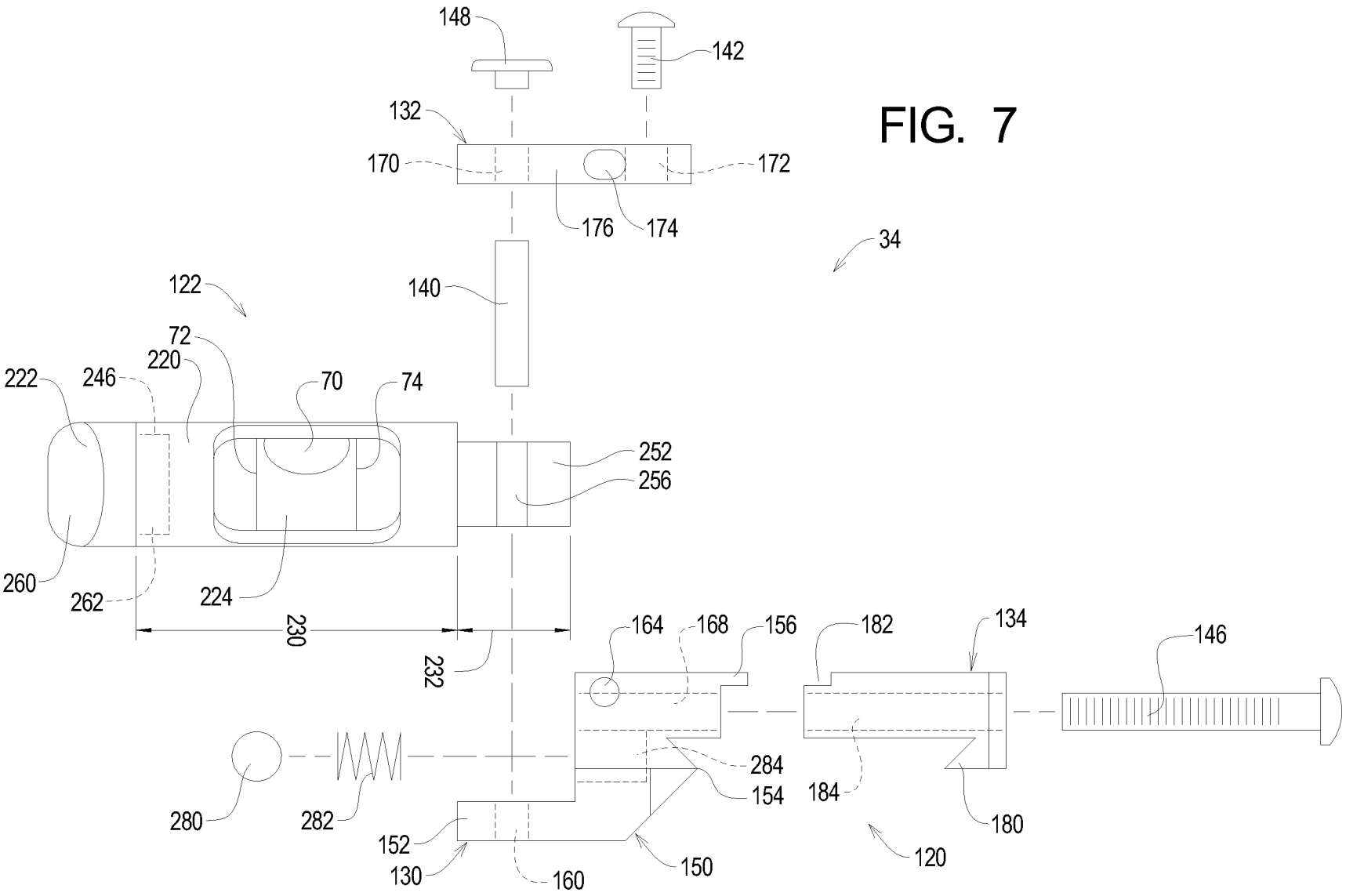
FIG. 7 is a front elevation exploded view of components of the first example level indicator.
Figure 8:
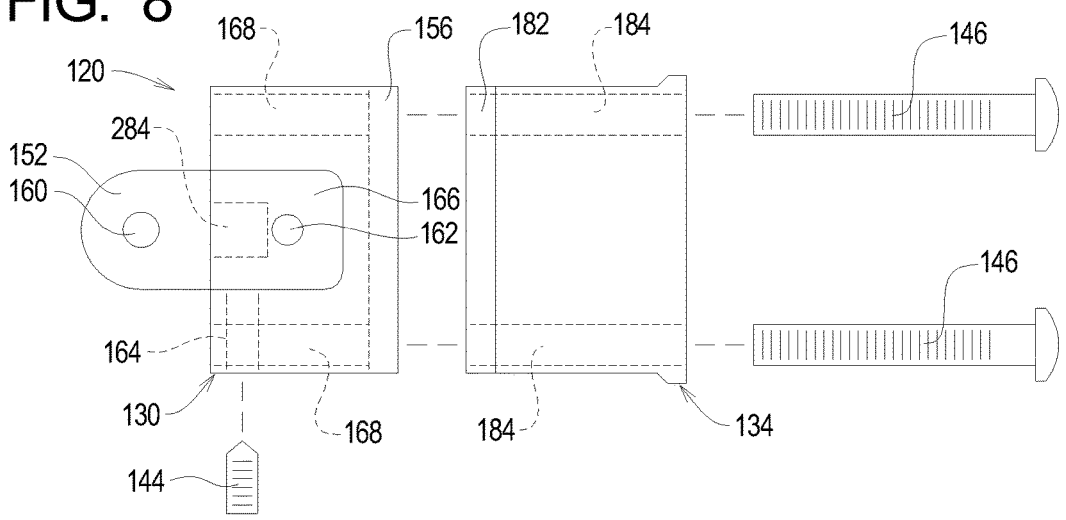
FIG. 8 is a top plan exploded view of components of the first example level indicator.

FIGS. 7 and 8 illustrate the details of construction and assembly of the first example level indicator system 34. The example level indicator system 34 comprises a base assembly 120 and a level assembly 122. The level assembly 122 is attached to the base assembly 120 for rotation to allow the example level indicator system 34 to be placed in any of the extended or first and second retracted configurations as described above and depicted in FIGS. 5 and 6.

The example base assembly 120 comprises a base member 130, a top plate 132, and a clamp member 134. The example base member 130 defines a base axis 136. A support member 140 connects the top plate 132 to the base member 130 and the level assembly 122 to the base assembly 120. In the example base assembly 120, a first screw 142 secures the top plate 132 in a desired configuration to the base member 130, and a second screw 144 (FIG. 8) further secures the top plate 132 in the desired configuration. The example base assembly 120 further comprises one or more clamp screws 146 arranged to fix a position of the clamp member 134 relative to the base member 130. In the example base assembly 120, a pivot cap 148 covers the support member 140. The example support member 140 is a pivot pin that allows the rotation of the level assembly 122 about a pivot axis relative to the base assembly 120, but pivoting movement of the level assembly relative to the base assembly 120 is optional.

The example base member 130 defines a main body 150, a support arm 152, at least one proximal clamp projection 154, and an overlap projection 156. A first pivot opening 160 is formed in the example support arm 150, and a first screw cavity 162 and a second screw opening 164 are formed in the main body 150. A plate notch 166 (FIG. 8) is formed in the main body 150. A clamp screw cavity 168 is formed in the main body 150 for each clamp screw(s) 146.

Figure 17:
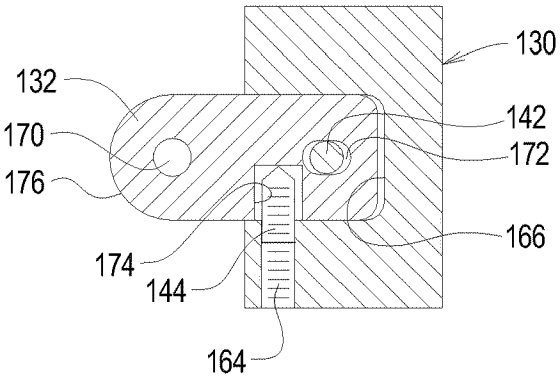
FIG. 17 is a section view taken along lines 17-17 in FIG. 11 illustrating a configuration of the first example level indicator at the intermediate adjustment location.
Figure 16:
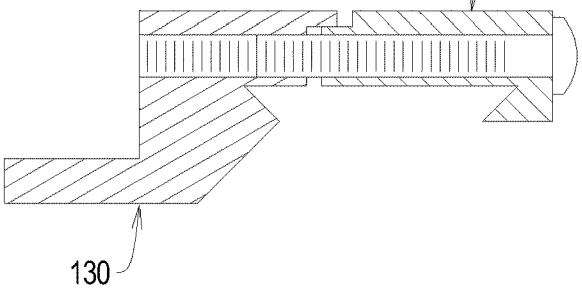
FIG. 16 is a section view taken along lines 16-16 in FIG. 5 illustrating a configuration of the first example level indicator when in a clamping configuration.
Figure 20:
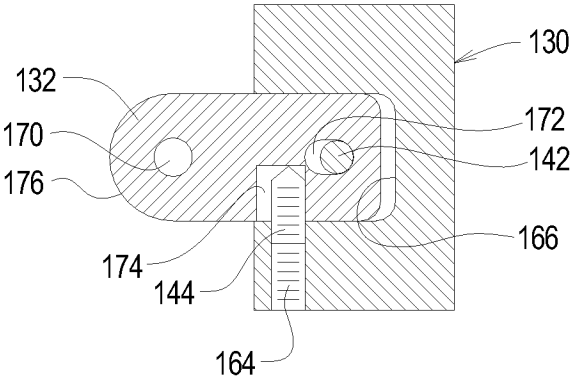
FIG. 20 is a section view similar to FIG. 17 illustrating a second adjustment limit of the first example level indicator.

The example top plate 132 is a flat plate defining a second pivot opening 170, a first screw opening 172, a second screw cavity 174, and a perimeter edge 176. The example second pivot opening 170 and example first screw opening 172 extend through the top plate 132, and the example second screw cavity 174 is formed in the perimeter edge 176. As perhaps best shown in FIGS. 17, 18, and 20, the first screw opening 172 is substantially perpendicular to the second screw opening 172. During normal use of the example level indicator 20, the first screw opening is substantially vertically arranged and substantially perpendicular to the barrel axis 50, while the second screw opening 174 is substantially horizontally arranged and substantially parallel to the barrel axis 50.

The example clamp member 134 defines at least one distal clamp projection 180, an overlap notch 182, and a clamp screw opening 184 for each clamp screw(s) 146.

Figure 10:
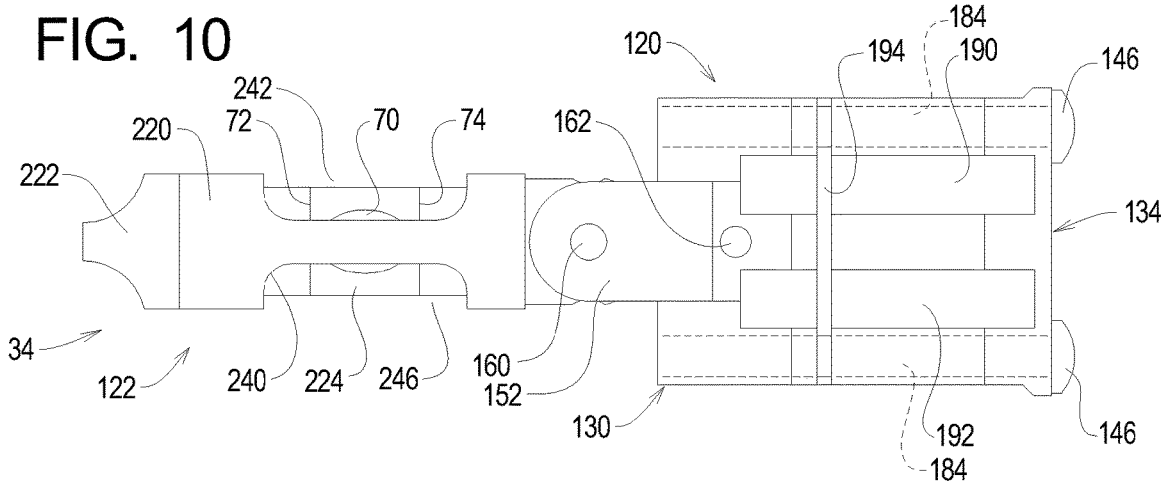
FIG. 10 is a bottom plan view of the first example level indicator.
Figure 11:
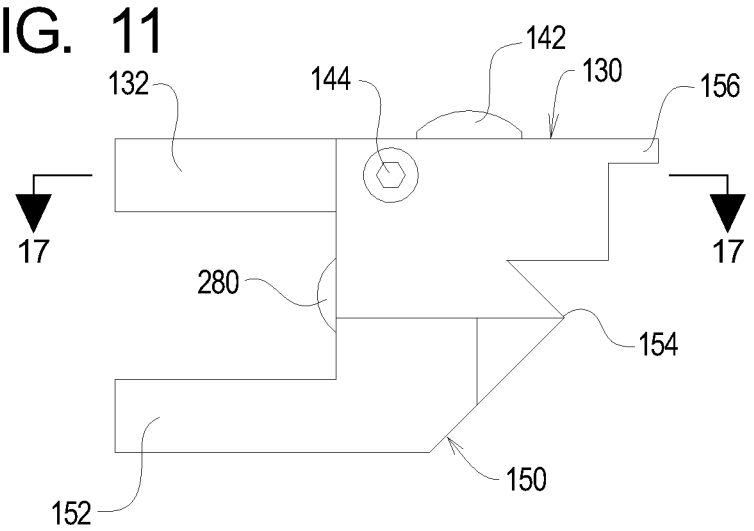
FIG. 11 is a front elevation view of a portion of a base assembly of the first example level indicator.

When the base assembly 120 is assembled, the base assembly 120 defines a first rail notch 190 and a second rail notch 192 as shown in FIG. 10 and a clamp gap 194 as shown in FIGS. 10, 15, 19, and 21. The overlap projection 156 extends over the clamp gap 194 and into the overlap notch 182 to cover the clamp gap 194 as perhaps best shown in FIGS. 15, 19, and 21.

Figure 9:
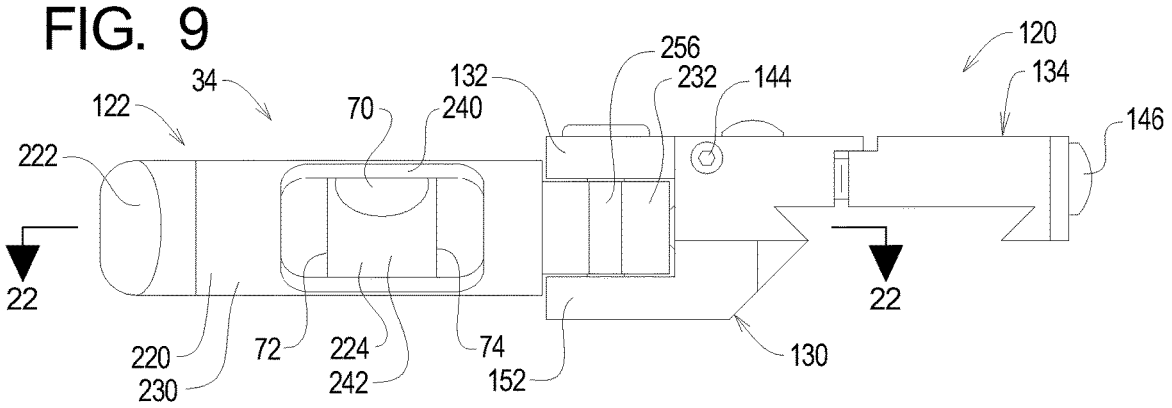
FIG. 9 is a front elevation view of the first example level indicator.

FIGS. 7, 9, and 10 illustrate that the example level assembly 122 comprises a level housing 220, a housing cap 222, a fluid level 224, and a detent system 226. The example level housing 220 defines a container portion 230 and a pivot portion 232. The example container portion defines a container chamber 240, first and second view openings 242 and 244, and an end opening 246. A level pivot opening 250 is formed in the example pivot portion 232. A pivot surface 252 extends around the example pivot portion 232 and is substantially parallel to the pivot opening 250. First, second, and third detent surfaces 254, 256, and 258 are formed in the pivot surface 252.

The example housing cap 222 defines a grip portion 260 and an engaging portion 262.

The example fluid level 224 comprises a vial 270 partly filled with fluid 272. The absence of fluid 272 within the vial 270 defines the bubble 70. The first and second bubble lines 72 and 74 are formed on the vial 270. The example vial 270 is or may be conventional and defines the level axis 54.

The example detent system 226 comprises a detent ball 280 and a detent spring 282. In the example detent system 226, a detent cavity 284 is formed in the base member 130 adjacent to the plate notch 166, and the detent spring 282 is arranged within the detent cavity 284. The detent ball 280 is arranged partly within the detent cavity 284 such that the detent spring 282 biases at least a portion of the detent ball 280 out of the detent cavity 284. The example detent system 226 is configured such that the detent spring 282 biases the detent ball 280 substantially along the base axis 136.

In use, the detent ball 280 engages one of the detent slots 354, 356, or 358 to secure the level assembly 122 in one of an extended, a first retracted, or a second retracted positions relative to the base assembly 120 corresponding to the extended, first retracted, and second retracted configurations of the example level indicator system 34. It should be recognized that the positions of the detent slots and detent ball may be reversed to obtain a similar locking function and further than other detent systems may be used instead of a ball and spring detent. In any detent system, the level assembly should be capable of being locked into any one of its positions relative to the base assembly but easily movable by deliberate application of manual force into any of the other positions.

To form the example level indicator system 34, the vial 270 is inserted through the end opening 246 and into the container chamber 240 of the container portion 230 of the level housing 220. The engaging portion 262 of the housing cap 222 is then inserted into the end opening 246 to inhibit inadvertent removal of the vial 270 from the container chamber 240.

Figure 15:
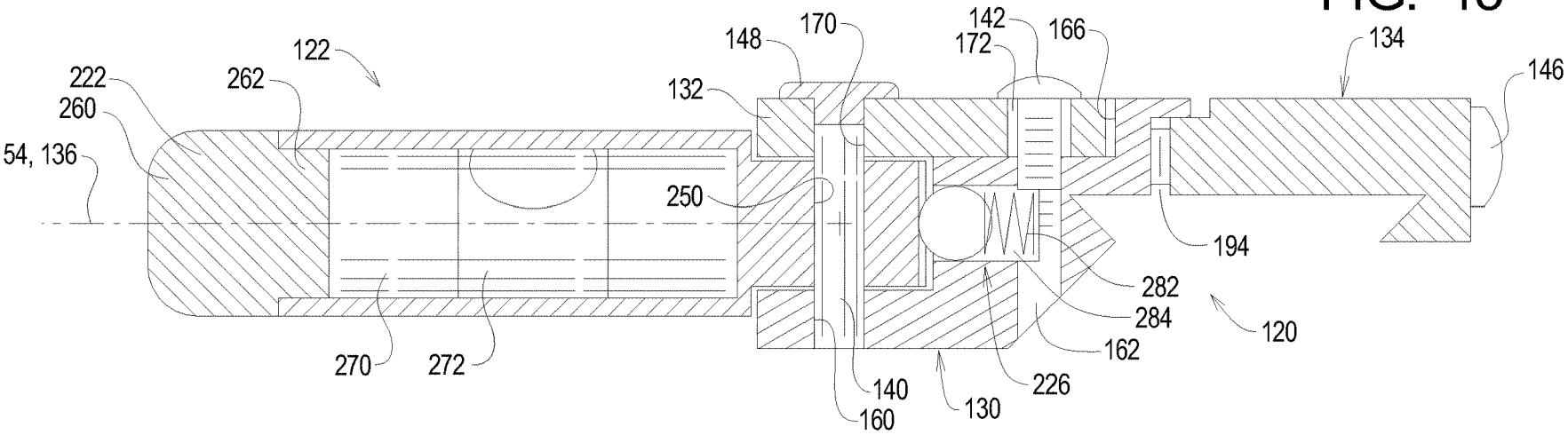
FIG. 15 is a section view taken along lines 15-15 in FIG. 5 illustrating an intermediate adjustment location of the first example level indicator.
Figure 18:
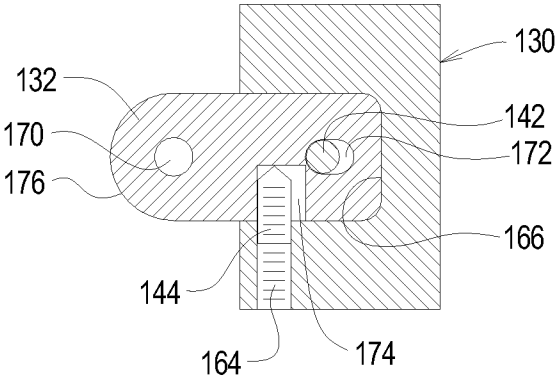
FIG. 18 is a section view similar to FIG. 17 illustrating a first adjustment limit of the first example level indicator.
Figure 19:
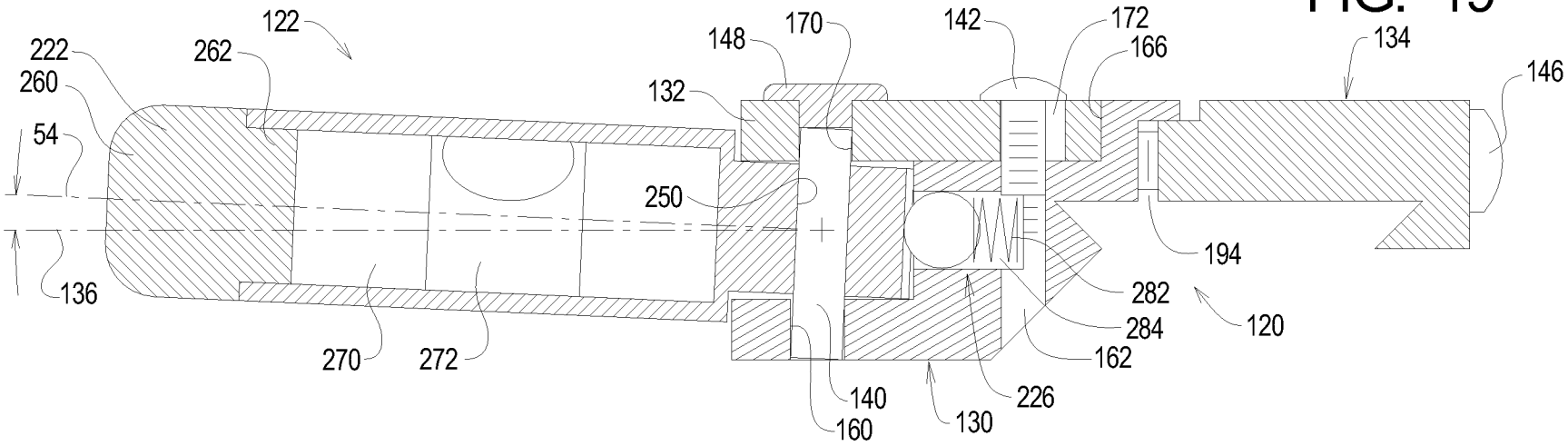
FIG. 19 is a section view similar to FIG. 15 illustrating a configuration of the first example level indicator at the first adjustment limit.
Figure 21:
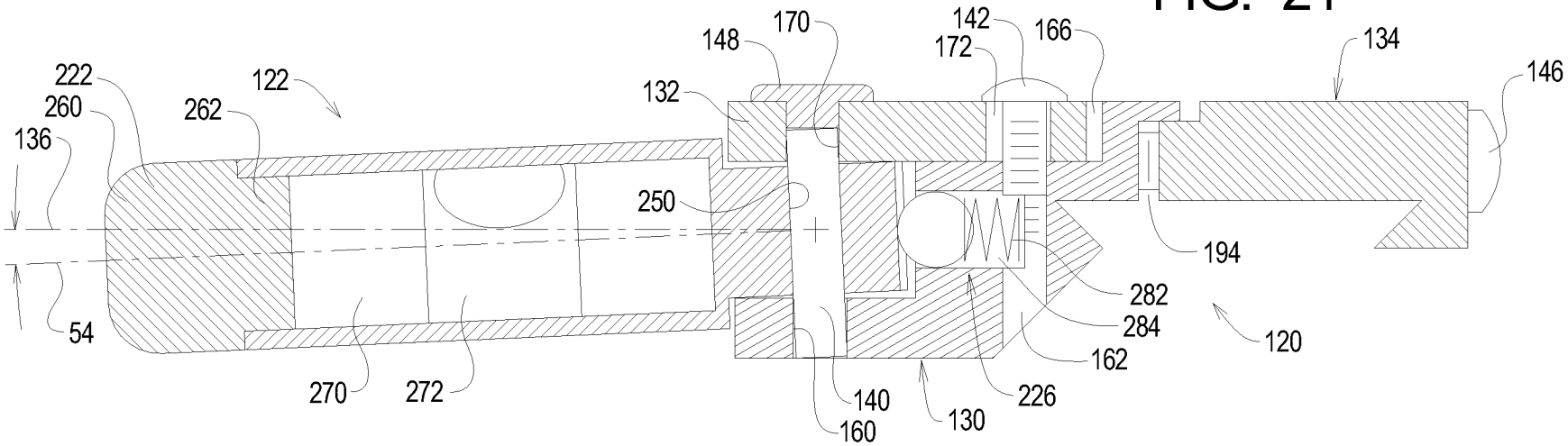
FIG. 21 is a section view similar to FIG. 15 illustrating a configuration of the first example level indicator at the second adjustment limit'
Figure 22:
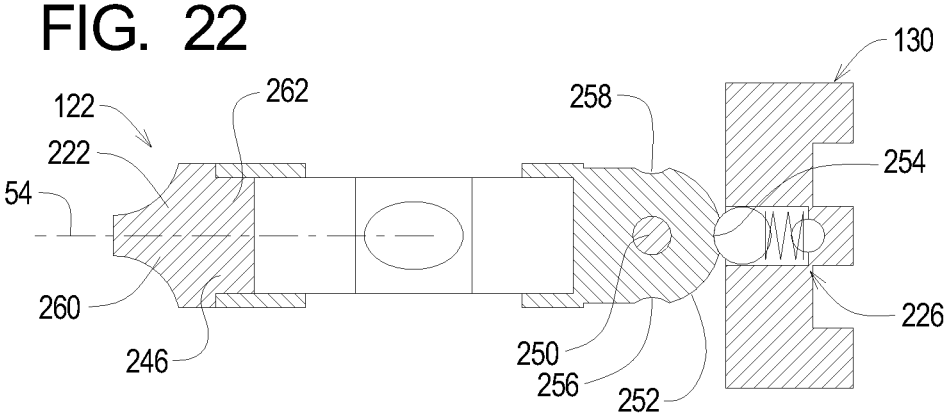
FIG. 22 is a section view taken along lines 22-22 in FIG. 9 illustrating the first example level indicator in the extended position.
Figure 24:
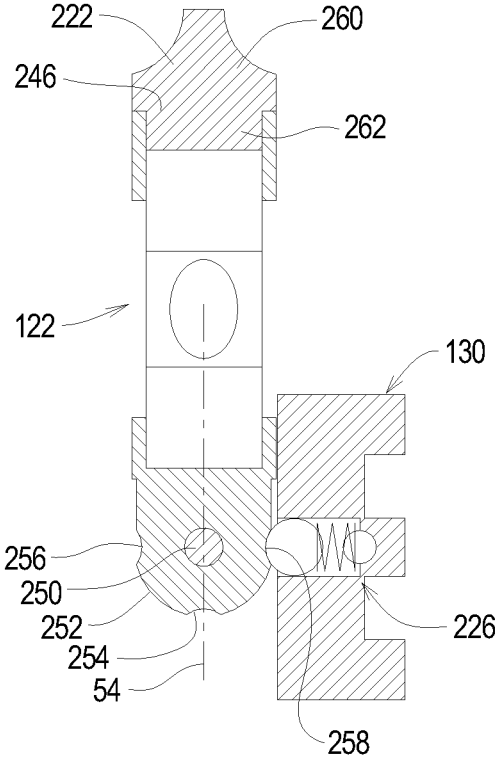
FIG. 24 is a section view similar to FIG. 22 illustrating the first example level indicator in the second retracted position.
Figure 23:
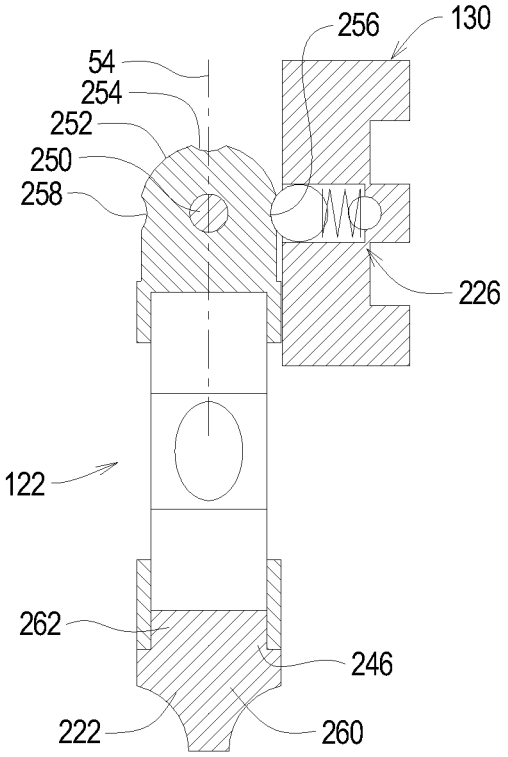
FIG. 23 is a section view similar to FIG. 22 illustrating the first example level indicator in the first retracted position.

Next, an insertion end of the example support member 140 is inserted through the second pivot opening 170 in the top plate 132 and through the level pivot opening 250 in the pivot portion 232 of the level housing 220. The pivot cap 148 is then inserted partly into the second pivot opening 170 in the top plate 132. The support member 140 is press fit into the level pivot opening 250 in the pivot portion 232 of the level housing 220 such that friction inhibits movement of the support member 140 relative to the level housing 220. Alternatively, the support member 140 may be threaded into the level pivot opening 250. The example first pivot opening 160 in the base member 130 and/or the example second pivot opening 170 in the top plate 132 may be slightly oversized relative to the support member 140 to allow movement of the support member 140 relative to the top plate 132. In any event, the example support member 140 is substantially rigidly secured to the level housing 220 such that movement of the support member 140 is translated into movement of the level assembly 122 as shown in FIGS. 15, 18, and 21.

The detent spring 282 is inserted into the detent cavity 284, and the detent ball 280 is arranged at least partly within the detent cavity 284 such that the detent spring 282 is compressed. The assembly of the support member 140 and the top plate 132 is arranged such that that the top plate 132 lies partly within the plate notch 166 and the insertion end of the example support member 140 extends at least partly into the first pivot opening 160 formed in the support arm 152 as perhaps best shown in FIGS. 15, 19, and 21. The perimeter edge 176 of the top plate 132 engages the portion of the base member 130 defining the plate notch 166 such that movement of the top plate 132 in either direction parallel to the barrel axis 50 is substantially prevented.

Further, at this point the detent ball 280 is held at least partly within the detent cavity 284 by the pivot surface 252 and/or at least one of the detent surfaces 254, 256, and 258. The example first pivot opening 160 in the support arm 152 of the base member 130 is slightly oversized relative to the support member 140 to allow movement of the support member 140 relative to the base member 130.

The first screw 142 is then inserted into the first screw opening 172 in the top plate 132 and threaded into the first screw cavity 162 in the base member 130. The second screw 144 is also threaded into the second screw opening 164 in the base member 130 such that the second screw 144 extends into the second screw cavity 174 in the top plate 132.

The clamp member 134 is next arranged relative to the base member 130 such that the overlap notch 182 receives the overlap projection 156 and the clamp screw cavities 168 are aligned with the clamp screw openings 184 in the clamp member 134. The clamp screw(s) 146 are then inserted through the clamp screw openings 184 and threaded into the clamp screw cavities 168.

Figure 12:
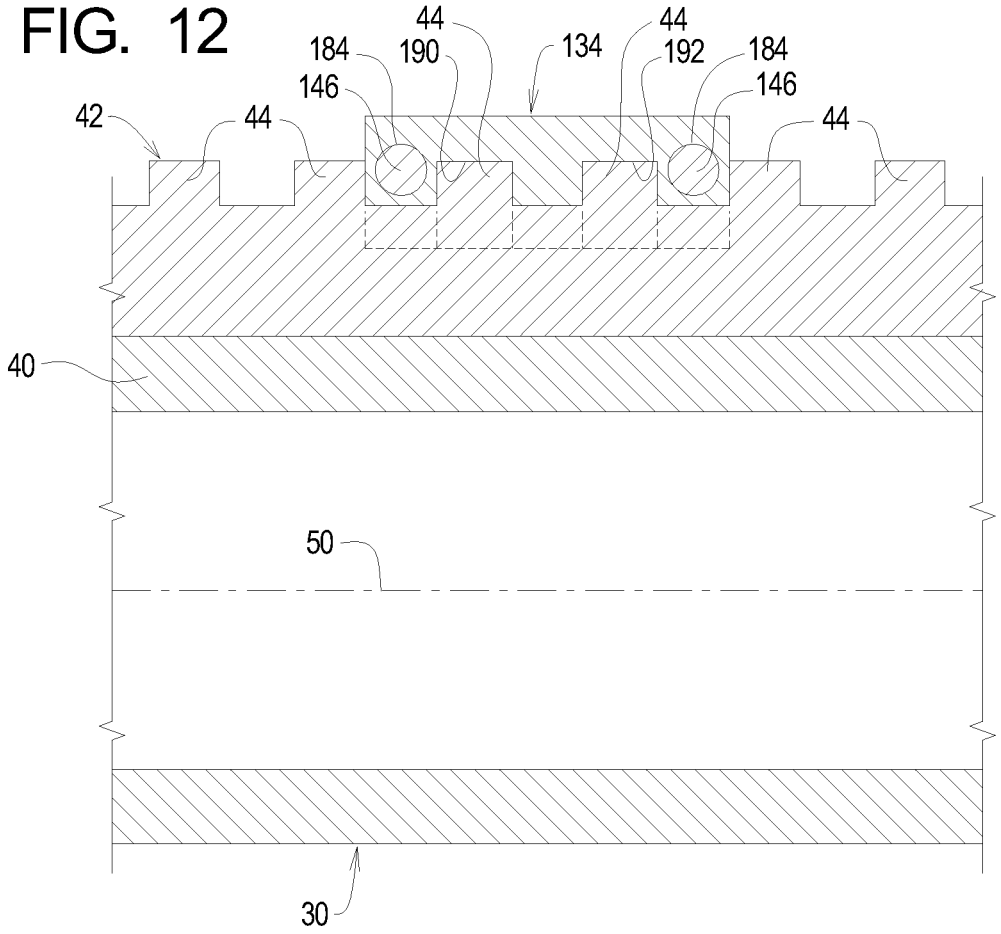
FIG. 12 is a section view taken along lines 12-12 in FIG. 2.

During normal use of the example level indicator system 34, before the clamp member 134 is attached to the base member 130, the base member 130 is arranged such that the proximal clamp projection(s) 154 engage the first rail edge 46 and the clamp member 134 is arranged such that the distal clamp projections 180 engage the second rail edge 48. At this point, the first and second rail notches 190 and 192 receive an adjacent pair of rail projections 44 as shown in FIG. 12. At this point, the clamp screw(s) 146 are inserted through the clamp opening(s) 184 in the clamp member 134 and threaded into the clamp cavities 168 in the base member 130 to clamp the rail 42 between the proximal and distal clamp projections 154 and 180. The base assembly 120 is securely attached to the rail 42 and thus to the barrel 40 and to the telescopic sight 32 that is also securely attached to the rail 42.

Ideally, at this point the level axis 54 is aligned with the base axis 136, the base axis 136 is aligned with the rail plane 56, and the rail plane 56 is aligned with the horizontal reticle plane 66 defined by the telescopic sight 32. In practice, however, due to manufacturing tolerances and other factors, the level axis 54 may not be parallel to the rail plane 56 and/or the horizontal reticle plane 66 when the example level indicator system 34 is attached to the rail 42 as described herein.

The example level indicator system 34 thus allows an angle of the level axis 54 relative to the base axis 136 to be adjusted to facilitate alignment of the level axis with the horizontal reticle plane 66. In particular, the example level indicator system 34 allows the level axis 54 to be altered relative to the base axis 136 within a range illustrated at a first end by FIG. 19 and at a second end by FIG. 21. FIG. 15 illustrates the level axis 54 at an intermediate point approximately midway between the first and second ends of the range of movement.

In particular, the first screw opening 172 and second screw cavity 174 formed in the top plate 132 are slightly elongated as shown in FIGS. 7, 15 and 17-21. The locations of the first and second screws 142 and 144 relative to the first screw opening 172 and the second screw cavity 174 may thus be altered within a limited range to allow the position of the top plate 132 relative to the base member 130 be altered from side to side.

To allow adjustment of the level axis 54 relative to the base axis 136, the first and second screws 142 and 144 are loosened to allow movement of the top plate 132 laterally side to side relative to the base member 130 within plate notch 166. With the first and second screws 142 and 144 loosened, the slight oversizing of the first and second pivot openings 160 and 170 allows the support member 140 to tilt relative to the support arm 152 and the top plate 132 as the top plate is moved laterally within the plate notch 166. The angle of the support member 140 relative to the base axis 136 and thus the angular location of the level axis 54 relative to the base axis 136 may be altered such that the level axis 54 is parallel to the horizontal reticle plane 66. When the level axis 54 is parallel to the horizontal reticle plane 66, the first and second screws 142 and 144 are tightened to frictionally engage the top plate 132 and secure the top plate 132 in the desired lateral position in which the level axis 54 is substantially parallel to the horizontal reticle plane 66.

Once the level axis 54 is substantially parallel to the horizontal reticle plane 66, the example level indicator system 34 may be used in the extended position as shown in FIGS. 3 and 4 to aim the firearm 30 using the telescopic sight 32 in a conventional manner. When the firearm 30 is stowed, the level indicator system 34 is arranged in one of the retracted positions. The example level indicator system 34 may be arranged on either side of the firearm 30 as preferred by the user.

What is claimed is:

1. A level indicator system for an aiming system comprising:

a base assembly comprising a base member defining a base axis and a first pivot opening, a plate defining a second pivot opening, and a support member; and a level assembly comprising a level indicator defining a level axis, where the level assembly defines a level pivot opening; wherein the base member and the plate support the support member such that a location of the plate relative to the base member is adjustable;

the support member supports the level assembly such that a location of the level axis relative to the base axis is altered when a location of the plate relative to the base member is adjusted; and the support member extends at least partly through the first pivot opening, at least partly through the second pivot opening, and at least partly through the level pivot opening to support the level assembly for pivoting movement relative to the base member.

2. A level indicator system as recited in claim 1, further comprising:

at least one screw opening formed in the plate; and at least one screw supported by the base member to extend at least partly into the at least one screw opening; whereby the at least one screw engages at least a portion of the plate to fix the location of the plate relative to the base member.

3. A level indicator system as recited in claim 1, further comprising:

first and second screw openings formed in the plate;

a first screw supported by the base member to extend at least partly into the first screw opening; and a second screw supported by the base member to extend at least partly into the second screw opening; whereby the first and second screws engage at least a portion of the plate to fix the location of the plate relative to the base member.

4. A level indicator system as recited in claim 3, in which the first screw opening is substantially orthogonal to the second screw opening.

5. A level indicator system as recited in claim 1, further comprising a detent system for securing the level assembly into at least one position relative to the base member.

6. A level indicator system as recited in claim 1, further comprising a detent system for securing the level assembly into a plurality of positions relative to the base member.

7. A level indicator system as recited in claim 1, further comprising a detent system for securing the level assembly into a first extended position, a second extended position, and a retracted position relative to the base member.

8. A level indicator system as recited in claim 1, in which:

at least first and second screw openings are formed in the plate;

a first screw is supported by the base member to extend at least partly into the first screw opening;

a second screw is supported by the base member to extend at least partly into the second screw opening; and the first and second screws engage at least a portion of the plate to fix the location of the plate relative to the base member.

9. A level indicator system as recited in claim 8, in which the first screw opening is substantially orthogonal to the second screw opening.

10. A method of leveling an aiming system comprising the steps of:

providing a base member defining a base axis;

forming a first pivot opening in the base member;

providing a plate;

forming a second pivot opening in the plate;

providing a support member;

providing a level assembly comprising a level indicator defining a level axis;

forming a level pivot opening in a level housing of the level assembly;

supporting the level assembly on the support member;

arranging the base member and the plate to support the support member such that a location of the plate relative to the base member is adjustable;

adjusting the location of the plate relative to the base member to alter a location of the level axis relative to the base axis; and arranging the support member to extend at least partly through the first pivot opening, at least partly through the second pivot opening, and at least partly through the level pivot opening to support the level assembly for pivoting movement relative to the base member.

11. A method as recited in claim 10, further comprising the steps of:

forming at least one screw opening in the plate; and supporting at least one screw with the base member such that the at least one screw extends at least partly into the at least one screw opening and engages at least a portion of the plate to fix the location of the plate relative to the base member.

12. A method as recited in claim 11, further comprising the steps of:

forming first and second screw openings in the plate;

supporting first and second screws on the base member such that the first and second screws extend at least partly into the first and second screw openings, respectively, and engage at least a portion of the plate to fix the location of the plate relative to the base member.

13. A method as recited in claim 12, in which the first screw opening is substantially orthogonal to the second screw opening.

14. A method as recited in claim 10, further comprising the step of arranging a detent system to secure the level assembly into at least one position relative to the base member.

15. A method as recited in claim 10, further comprising the step of arranging a detent system to secure the level assembly into a plurality of positions relative to the base member.

16. A method as recited in claim 10, further comprising further comprising the step of arranging a detent system to secure the level assembly into a first extended position, a second extended position, and a retracted position relative to the base member.

17. A level indicator system for an aiming system comprising:

a base assembly comprising a base member defining a base axis, a plate notch, and a first pivot opening, a plate defining at least one screw opening and a second pivot opening, a support member, and at least one screw; and a level assembly comprising a level housing defining a level pivot opening, and a level indicator defining a level axis, where the level housing supports the level indicator; wherein the plate is supported by the plate notch in the base member;

the support member extends at least partly through the first pivot opening, at least partly through the second pivot opening, and at least partly through the level pivot opening such that the level assembly pivots relative to the base member, and the support member supports the level assembly such that a location of the level axis relative to the base axis is altered when a location of the plate relative to the base member is adjusted;

the at least one screw is supported by the base member to extend at least partly into the at least one screw opening; and the at least one screw engages at least a portion of the plate to fix the location of the plate relative to the base member.

18. A level indicator system as recited in claim 17, further comprising a detent system for securing the level assembly into at least one position relative to the base member.

* * * * *